US011215192B2

(12) United States Patent
Lin et al.

(10) Patent No.: US 11,215,192 B2
(45) Date of Patent: Jan. 4, 2022

(54) FAN

(71) Applicant: ASUSTeK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 189 days.

(21) Appl. No.: 16/264,903

(22) Filed: Feb. 1, 2019

(65) Prior Publication Data

US 2019/0249686 A1 Aug. 15, 2019

(30) Foreign Application Priority Data

Feb. 13, 2018 (CN) ..... 201810148579.4

(51) Int. Cl.
*F04D 29/42* (2006.01)
*F04D 27/00* (2006.01)
*F04D 17/16* (2006.01)

(52) U.S. Cl.
CPC ..... *F04D 29/4226* (2013.01); *F04D 27/002* (2013.01); *F04D 17/16* (2013.01)

(58) Field of Classification Search
CPC .... F04D 27/002; F04D 29/4226; F04D 17/16; F04D 29/4206; F04D 29/40; F04D 29/4213; F04D 29/287
See application file for complete search history.

(56) References Cited

U.S. PATENT DOCUMENTS 7,753,227 B2 * 7/2010 Guo ..... B65D 43/164 220/830
8,622,646 B2 1/2014 Quan et al.
8,967,425 B2 * 3/2015 Lee ..... G03B 17/02 220/848
10,079,123 B2 9/2018 Yu
2010/0124953 A1 * 5/2010 Yang ..... H04M 1/0237 455/575.3

(Continued)

FOREIGN PATENT DOCUMENTS

CN 202100517 U 1/2012
CN 102421266 A 4/2012
CN 202280632 U 6/2012

(Continued)

OTHER PUBLICATIONS

Espacenet Machine Translation of Hu et al. (CN 202280632), 2021 (Year: 2021).*

*Primary Examiner* — Courtney D Heinle
*Assistant Examiner* — Andrew Thanh Bui
(74) *Attorney, Agent, or Firm* — McClure, Qualey & Rodack, LLP

(57) ABSTRACT

This disclosure provides a fan, including a first case, a second case, and a reset mechanism. The first case includes a first side wall, where the first side wall has a first guide portion. The second case includes a second side wall, where the second side wall has a second guide portion. The first guide portion and the second guide portion are slidably joined and are configured to enable the first case and the second case to move toward or away from each other. The reset mechanism is connected to the first case and is configured to push the second case to move away from the first case.

8 Claims, 8 Drawing Sheets

(56) References Cited

U.S. PATENT DOCUMENTS

| | | | | |
|---|---|---|---|---|
| 2017/0363097 | A1 | 12/2017 | Lin et al. | |
| 2020/0309138 | A1* | 10/2020 | Tsai | F04D 29/4226 |

FOREIGN PATENT DOCUMENTS

| | | | |
|---|---|---|---|
| CN | 202503148 | U | 10/2012 |
| CN | 106158470 | A | 11/2016 |
| CN | 205689464 | U | 11/2016 |
| TW | 187453 | | 7/1992 |

* cited by examiner

FAN

CROSS-REFERENCE TO RELATED APPLICATION

This application claims the priority benefit of China application serial No. 201810148579.4, filed on Feb. 13, 2018. The entirety of the above-mentioned patent application is hereby incorporated by reference herein and made a part of the specification.

BACKGROUND OF THE INVENTION

Field of the Invention

This disclosure relates to a fan, and in particular, to a fan housing.

Description of the Related Art

A common fan has a housing having a fixed size. Usually, a rational speed of a rotor is adjusted or the size of the fan is increased to obtain required air volume when air volume needs to be adjusted. However, requirements of light and thin design is considered for a portable device. Therefore, according to the requirements, a thin fan is selected. Because of the performance of a fan is limited by its size, so that a request for larger air volume can only be met by increasing a rotational speed of the fan to adjust air volume. However, the increased rational speed brings a significant noise. If a fan having a larger size is selected and used, although the performance is good but the dimension of a product is increased.

BRIEF SUMMARY OF THE INVENTION

This disclosure provides a fan, including a first case, a second case, and a reset mechanism. The first case includes a first side wall, where the first side wall has a first guide portion. The second case includes a second side wall, where the second side wall has a second guide portion. The first guide portion and the second guide portion are slidably joined, and are configured to enable the first case and the second case to move toward or away from each other. The reset mechanism is connected to the first case, and is configured to push the second case to move away from the first case.

In conclusion, the fan provided in this disclosure has a variable volume, and is allowed to be disposed in various system cases having different sizes. In addition, the reset mechanism in this disclosure occupies only a small external volume, and is able to be adjusted in a plurality of ranges to meet various practical requirements.

To make the foregoing features and advantages of this disclosure more comprehensible, embodiments are described in detail below with the accompanying drawings.

DETAILED DESCRIPTION OF THE EMBODIMENTS

A plurality of implementations of the present disclosure is disclosed below with reference to the figures. For clarity, practical details are also described below.

Figure 1A:
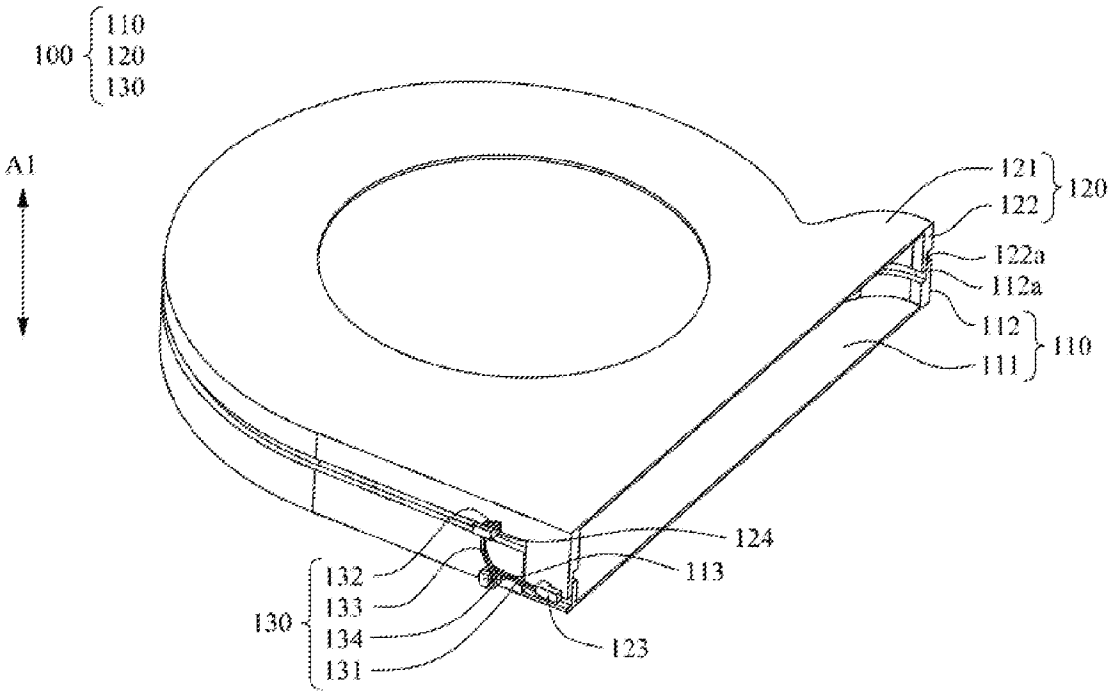
FIG. 1A is a three-dimensional diagram of a fan housing in an extended state according to a first implementation of this disclosure.
Figure 1B:
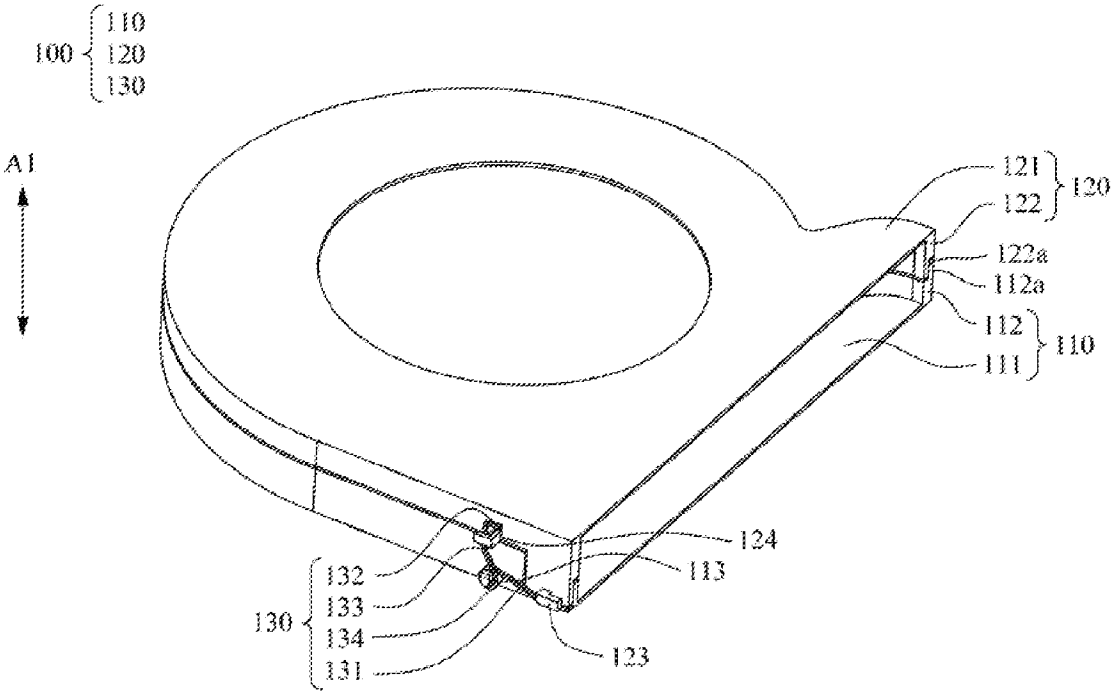
FIG. 1B is a three-dimensional diagram of the fan housing in FIG. 1A in a folded state.

Refer to FIG. 1A and FIG. 1B. FIG. 1A is a three-dimensional diagram of a housing of a fan 100 in an extended state according to an implementation of this disclosure. FIG. 1B is a three-dimensional diagram of the housing of the fan 100 in FIG. 1A in a folded state.

As shown in FIG. 1A and FIG. 1B, this disclosure provides a fan 100, including a first case 110, a second case 120, and a reset mechanism 130. The first case 110 includes a first board 111, a first side wall 112, and a third projection 113. The first side wall 112 has a first guide portion 112*a*. The second case 120 includes a second board 121, a second side wall 122, a first projection 123, and a second projection 124. The second side wall 122 has a second guide portion 122*a*. The first guide portion 112*a* and the second guide portion 122*a* are slidably joined, and are configured to enable the first case 110 and the second case 120 to move toward or away from each other in a first direction A1. The reset mechanism 130 is connected to the first case 110, and includes a pushing portion 131, a stopping portion 132, and an abutting portion 133. The reset mechanism 130 pushes the second case 120 away from the first case 110 by using the pushing portion 131, and prevents, by using the stopping portion 132, the first case 110 from being completely removed from the second case 120.

The reset mechanism 130 is configured to adjust a relative distance between the first case 110 and the second case 120, and a whole volume of the fan 100 varies accordingly. In an embodiment, the housing of the fan 100 in FIG. 1A is in the extended state, and the housing of the fan 100 in FIG. 1B is in the folded state. Therefore, the fan 100 in FIG. 1A and FIG. 1B has a flexibly adjustable volume. Therefore, the fan 100 is allowed to be disposed in various system cases having different size specifications.

As shown in FIG. 1A, when the housing of the fan 100 is in the extended state, the first guide portion 112*a* of the first side wall 112 and the second guide portion 122*a* of the second side wall 122 partially abut each other. As shown in FIG. 1B, when the housing of the fan 100 is in the folded state, the first guide portion 112*a* of the first side wall 112 and the second guide portion 122*a* of the second side wall 122 wholly abut each other. When the distance between the first case 110 and the second case 120 changes, after the first guide portion 112*a* and the second guide portion 122*a* abut each other, both the first side wall 112 and the second side wall 122 prevent an air flow from flowing out the fan 100 through a gap between the first guide portion 112*a* and the second guide portion 122*a* in a radial direction (that is, a direction perpendicular to the first direction A1).

Figure 2B:
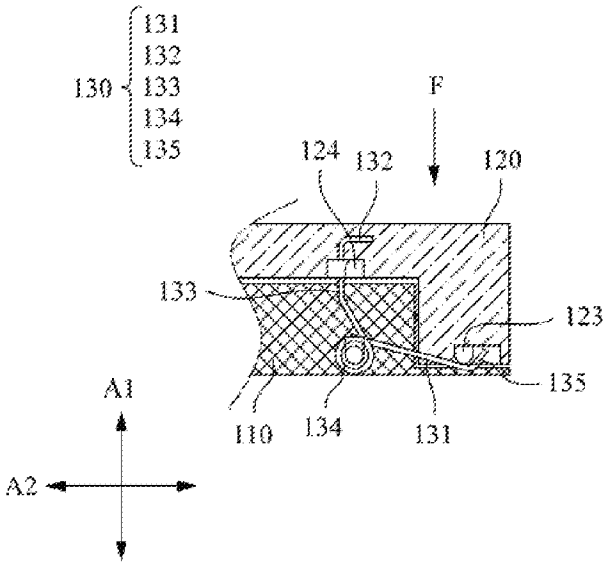
FIG. 2B is a side view of a reset mechanism of the fan housing in FIG. 1B.
Figure 2A:
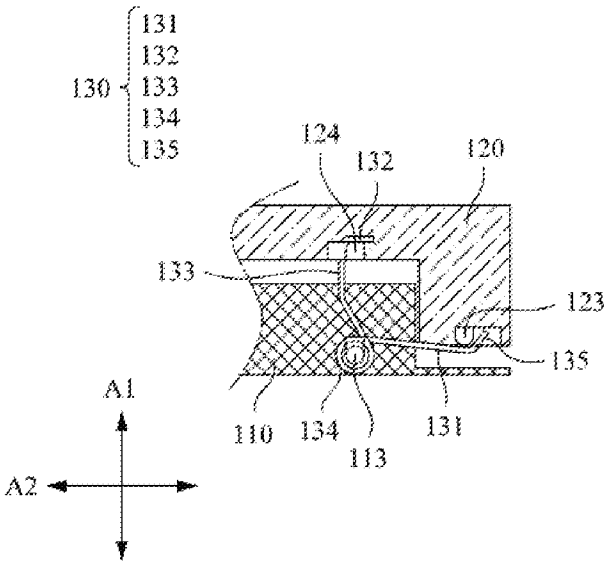
FIG. 2A is a side view of a reset mechanism of the fan housing in FIG. 1A.

Refer to FIG. 2A and FIG. 2B. FIG. 2A is a side view of the reset mechanism 130 of the fan 100 in FIG. 1A, and FIG. 2B is a side view of the reset mechanism 130 of the fan 100 in FIG. 1B. As shown in FIG. 2A and FIG. 2B, the reset mechanism 130 of the fan 100 is a rotary spring. In addition to the pushing portion 131, the stopping portion 132, and the abutting portion 133, the reset mechanism 130 further includes a connecting portion 134. The pushing portion 131 and the abutting portion 133 are rod-shaped structures, and the connecting portion 134 is an elastic structure. The pushing portion 131 is connected to the abutting portion 133 by using the connecting portion 134. The stopping portion 132 is connected to an end that is of the abutting portion 133 and that is distant from the first case 110. In this implementation, the connecting portion 134 is a ring-shaped structure, and an axial direction of the connecting portion 134 is perpendicular to the first direction A1. In this implementation, lap winding is performed only once by using the connecting portion 134. Therefore, when the connecting portion 134 is flattened against and disposed on the first side wall 112 of the first case 110, the connecting portion 134 does not protrude from a side of the first side wall 112 by an excessively long distance. In this way, lateral space occupied by the whole fan 100 in a system case is effectively reduced.

As shown in FIG. 2A, the ring-shaped connecting portion 134 is sleeved over the third projection 113. Through the connecting portion 134, the pushing portion 131 extends to the first projection 123 disposed on the second case 120. Because the connecting portion 134 is an elastic structure and applies a force moment on the pushing portion 131, the pushing portion 131 pushes the first projection 123, and further lifts the second case 120 relative to the first case 110. In this way, the first case 110 and the second case 120 are extended relative to each other. As shown in FIG. 2B, an external force F toward the first case 110 is applied to the second case 120 in the first direction A1. In addition, when the external force F is greater than a force applied by the connecting portion 134, the pushing portion 131 moves toward the first case 110, so that the relative distance between the first case 110 and the second case 120 is reduced.

As shown in FIG. 2A and FIG. 2B, an end of the pushing portion 131 that is distant from the connecting portion 134 further includes a clasp portion 135. In addition, the first projection 123 in this implementation is actually of an L shape. The clasp portion 135 is bent toward the second case 120 relative to the pushing portion 131. During a relative displacement between the first case 110 and the second case 120, the clasp portion 135 is clasped between the first projection 123 and the second side wall 122, to avoid that the pushing portion 131 does not push the first projection 123 because the pushing portion 131 leaves the first projection 123.

As shown in FIG. 2A and FIG. 2B, a part of the abutting portion 133 is actually parallel to the first direction A1. Because the connecting portion 134 is an elastic structure, the connecting portion 134 applies a force moment on the abutting portion 133, so that the abutting portion 133 pushes, in a second direction A2 perpendicular to the first direction A1, the second projection 124 disposed on the second case 120. Therefore, during the relative displacement between the first case 110 and the second case 120, the second projection 124 and the abutting portion 133 slidably abut each other. In addition, the second projection 124 in this implementation is actually of an L shape. When the relative displacement between the first case 110 and the second case 120 occurs, the abutting portion 133 is clasped between the second projection 124 and the second side wall 122, to avoid that the second projection 124 is not constrained because the stopping portion 132 leaves a motion path of the second projection 124.

As shown in FIG. 2A and FIG. 2B, the stopping portion 132 of the reset mechanism 130 is bent relative to the abutting portion 133. In this implementation, the stopping portion 132 extends in the second direction A2. As shown in FIG. 2A, when no external force F is applied to the second case 120, the pushing portion 131 lifts the second case 120 relative to the first case 110 until the second projection 124 abuts against the stopping portion 132. The relative distance between the first case 110 and the second case 120 is limited to a range by disposing the stopping portion 132, to prevent the first case 110 from being completely removed from the second case 120. In some implementations, the fan 100 mounted inside the system case limits a movement distance of the second case 120 relative to the first case 110 by using an external element (in an embodiment, an upper cover of the system case). In this case, the reset mechanism 130 does not need to be provided with the stopping portion 132.

FIG. 3A to FIG. 7B disclose other embodiments of a reset mechanism of a fan in this disclosure. For descriptions related to a first case and a second case of the fan in subsequent embodiments, refer to the foregoing descriptions for FIG. 1A and FIG. 1B.

Figure 3B:
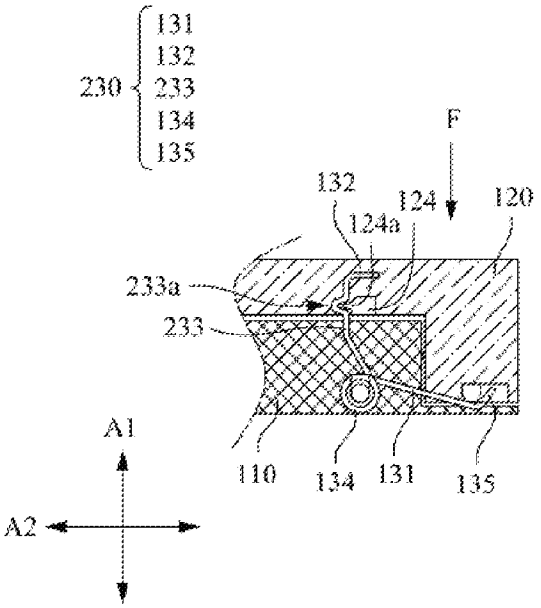
FIG. 3B is a side view of the reset mechanism when the fan housing in FIG. 3A is in a folded state.
Figure 3A:
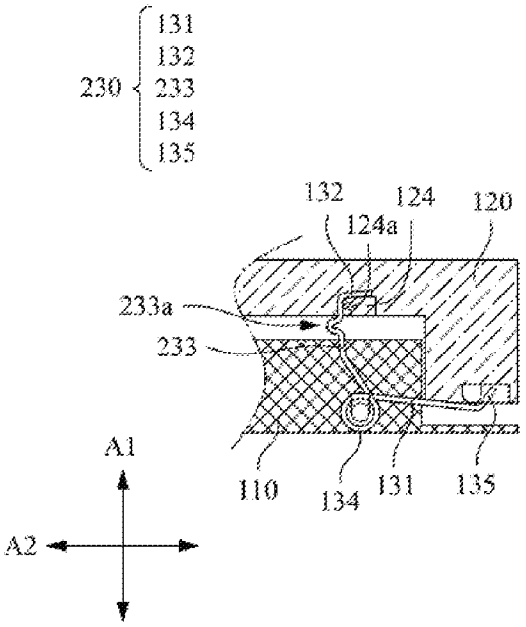
FIG. 3A is a side view of a reset mechanism when a fan housing is in an extended state according to a second implementation of this disclosure.

Refer to FIG. 3A and FIG. 3B. FIG. 3A is a side view of a reset mechanism 230 when a housing of a fan 100 is in an extended state according to an implementation; and FIG. 3B is a side view of the reset mechanism 230 when the housing of the fan 100 in FIG. 3A is in a folded state. A difference between this implementation and the implementation in FIG. 2A is that: in this implementation, an abutting portion 233 of the reset mechanism 230 further has a first engaging structure 233*a*, and a second projection 124 disposed on the second case 120 further has a locking convex structure 124*a*. The first engaging structure 233*a* is configured to engage with the locking convex structure 124*a*. In this implementation, the first engaging structure 233*a* is a groove-shaped structure in a middle segment of the rod-shaped abutting portion 233. The locking convex structure 124*a* is a protruding structure extending from the second projection 124 toward the abutting portion 233, and an outline of the locking convex structure 124*a* matches that of the first engaging structure 233*a*.

As shown in FIG. 3A, in the extended state, the stopping portion 132 constrains the second projection 124, so that the second case 120 is not completely removed from the first case 110. As shown in FIG. 3B, when an external force F is used to press the second case 120 until the locking convex structure 124*a* aligns with the first engaging structure 233*a*, the locking convex structure 124*a* is clasped in the first engaging structure 233*a*. The locking convex structure 124*a* and the first engaging structure 233*a* that are engaged with each other constrains the second case 120, so that the second case 120 does not freely move in a first direction A1. When the fan 100 is in the state in FIG. 3B, if it is intended to change relative positions of the first case 110 and the second case 120, the stopping portion 132 is reversely pushed in a second direction A2 relative to the locking convex structure 124*a*, so that the first engaging structure 233*a* is removed from the locking convex structure 124*a*, and the second case 120 freely moves in the first direction A1. Based on the foregoing design, the second case 120 is allowed to be fixed at a plurality of positions relative to the first case 110, and in an embodiment, at a first position defined by the stopping portion 132 or a second position defined by the first engaging structure 233*a*.

In some implementations, the abutting portion 233 is designed to have a plurality of first engaging structures 233*a*. When the locking convex structure 124*a* of the second projection 124 is engaged with different first engaging structures 233*a*, a relative distance between the second case 120 and the first case 110 also varies accordingly. In an embodiment, when two first engaging structures 233*a* are provided on the abutting portion 233, the second case 120 is allowed to be fixed, relative to the first case 110, at a first position defined by the stopping portion 132, a second position defined by a first engaging structure 233*a*, or a third position defined by a second first engaging structure 233*a*.

Figures 4A, 4B, 4C:
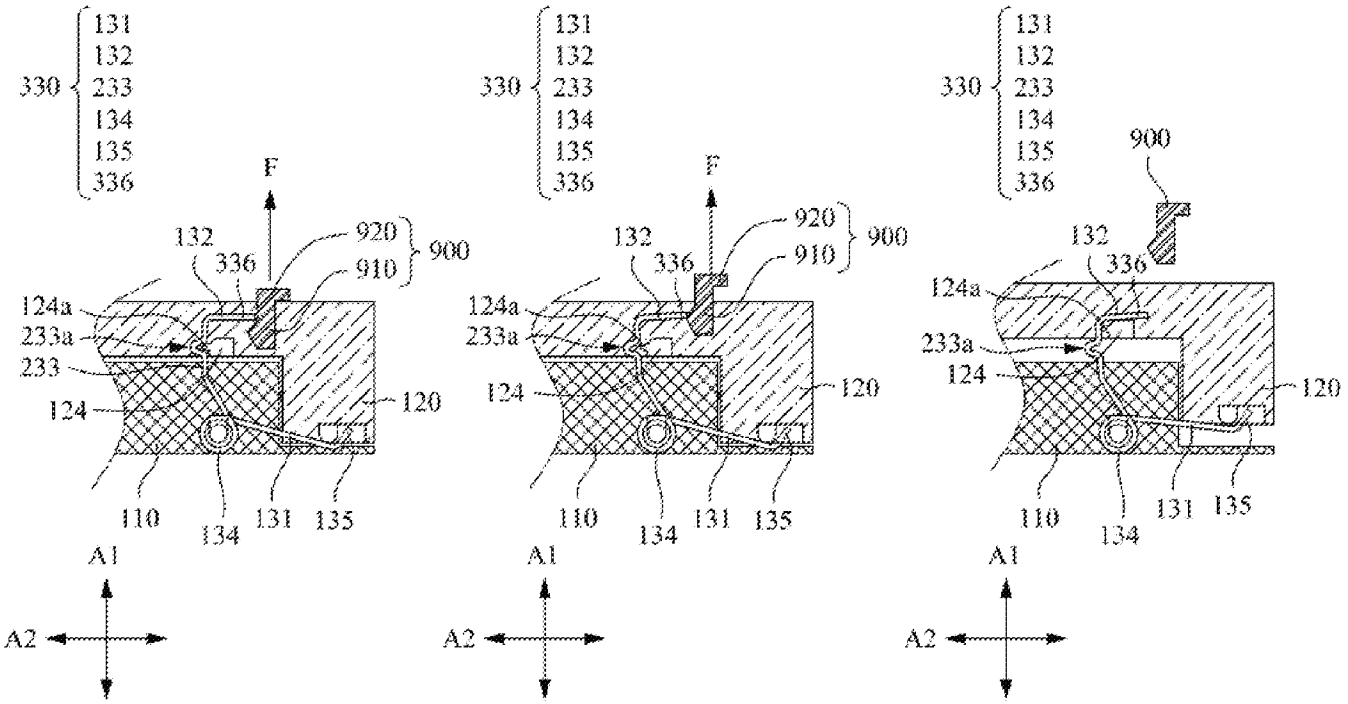
FIG. 4A is a side view of a reset mechanism when a fan housing is in a folded state according to an implementation of this disclosure.
FIG. 4B is a side view of the reset mechanism that is in FIG. 4A and whose abutting portion is removed from a second projection.
FIG. 4C is a side view of the reset mechanism when the fan housing in FIG. 4A is in an extended state.

Refer to FIG. 4A, FIG. 4B, and FIG. 4C. FIG. 4A is a side view of a reset mechanism 330 when a housing of a fan 100 is in a folded state according to an implementation of this disclosure; FIG. 4B is a side view of the reset mechanism 330 that is in FIG. 4A and whose abutting portion 233 is removed from a second projection 124; and FIG. 4C is a side view of the reset mechanism 330 when the fan 100 in FIG. 4A is in an extended state. A difference between this implementation and the implementation in FIG. 3A and FIG. 3B is that in this implementation, the reset mechanism 330 further includes an extended portion 336. As shown in FIG. 4C, in this implementation, the extended portion 336 continues to extend from an end portion of a stopping portion 132 in a second direction A2 and is configured to abut an external component 900.

As shown in FIG. 4A, the external component 900 includes a driving portion 910 and a lifting portion 920. When the housing of the fan 100 is in the folded state, the extended portion 336 abuts against the lifting portion 920, and the driving portion 910 extends toward a pushing portion 131 and a part of the driving portion 910 is located between the extended portion 336 and a first case 110. As shown in FIG. 4B, when it is intended to lift a second case 120, an external force F is used to lift the lifting portion 920 in a first direction A1. In this case, the driving portion 910 drives the extended portion 336, and drives the abutting portion 233, so that a first engaging structure 233*a* is removed from a locking convex structure 124*a*. As shown in FIG. 4C, after the first engaging structure 233*a* is removed from the locking convex structure 124*a*, the pushing portion 131 lifts the second case 120 in the first direction A1 until the second projection 124 abuts against the stopping portion 132. The extended portion 336 extends from the stopping portion 132, and the extended portion 336 is driven by using the external component 900, so that the stopping portion 132 does not need to be manually driven according to the implementation shown in FIG. 3A.

Figures 5A, 5B, 5C:
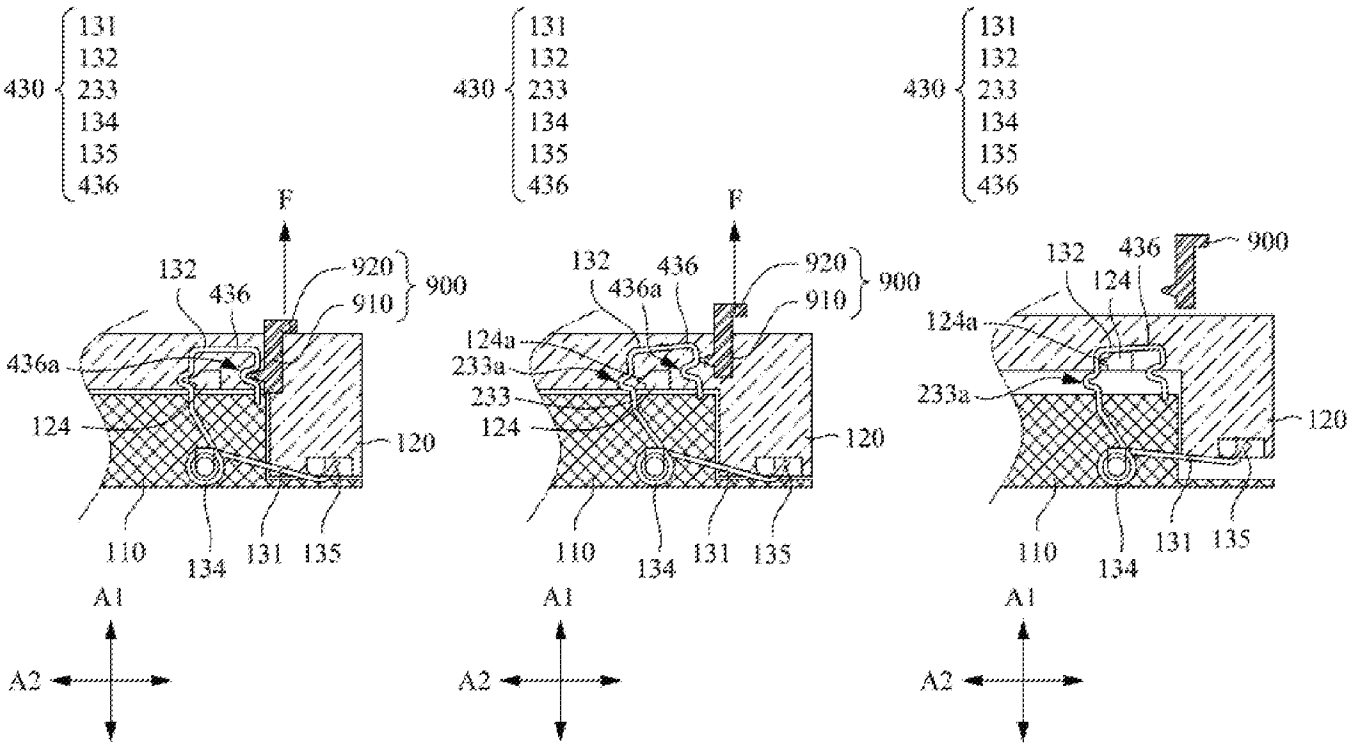
FIG. 5A is a side view of a reset mechanism when a fan housing is in a folded state according to an implementation of this disclosure.
FIG. 5B is a side view of the reset mechanism that is in FIG. 5A and whose abutting portion is removed from a second projection.
FIG. 5C is a side view of the reset mechanism when the fan housing in FIG. 5A is in an extended state.

Next, refer to FIG. 5A, FIG. 5B, and FIG. 5C. FIG. 5A is a side view of a reset mechanism 430 when a housing of a fan 100 is in a folded state according to an implementation of this disclosure; FIG. 5B is a side view of the reset mechanism 430 that is in FIG. 5A and whose abutting portion 233 is removed from a second projection 124; and FIG. 5C is a side view of the reset mechanism 430 when the housing of the fan 100 in FIG. 5A is in an extended state. A difference between this implementation and the implementation in FIG. 4A, FIG. 4B, and FIG. 4C is that: in this implementation, an extended portion 436 of the reset mechanism 430 is further bent relative to a stopping portion 132, and the extended portion 436 further includes a second engaging structure 436*a*.

As shown in FIG. 5A, in this implementation, the extended portion 436 extends from the stopping portion 132 in a second direction A2, and then extends toward the first case 110 in a first direction A1, forming an L-shaped bent structure. The second engaging structure 436*a* is on a part that is of the extended portion 436 and that extends in the first direction A1. In this implementation, the second engaging structure 436*a* is a groove-shaped structure in a middle segment of the extended portion 436 in the first direction A1. A driving portion 910 of an external component 900 is a locking convex structure. When the housing of the fan 100 is in the folded state, the driving portion 910 is engaged with the second engaging structure 436*a*.

As shown in FIG. 5B, when it is intended to lift a second case 120, an external force F is used to lift a lifting portion 920 in the first direction A1. In this case, the driving portion 910 drives the second engaging structure 436*a* of the extended portion 436, and drives the abutting portion 233, so that a first engaging structure 233*a* is removed from a locking convex structure 124*a*. As shown in FIG. 5C, after the first engaging structure 233*a* is removed from the locking convex structure 124*a*, a pushing portion 131 lifts the second case 120 in the first direction A1 until the second projection 124 abuts against the stopping portion 132. The extended portion 436 extends from the stopping portion 132, and the extended portion 436 is driven by using the external component 900, so that the stopping portion 132 does not need to be manually driven according to the implementation shown in FIG. 3A.

Figure 6B:
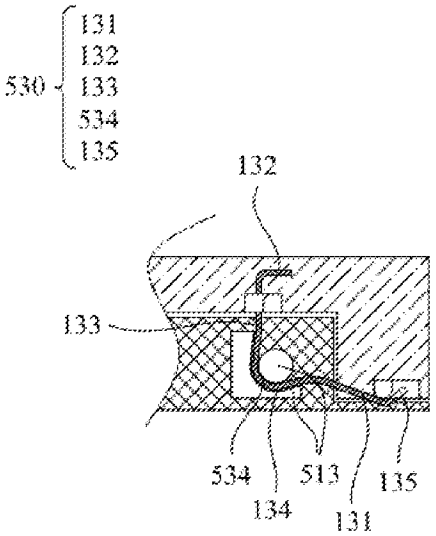
FIG. 6B is a side view of the reset mechanism when the fan housing in FIG. 6A is in a folded state.
Figure 6A:
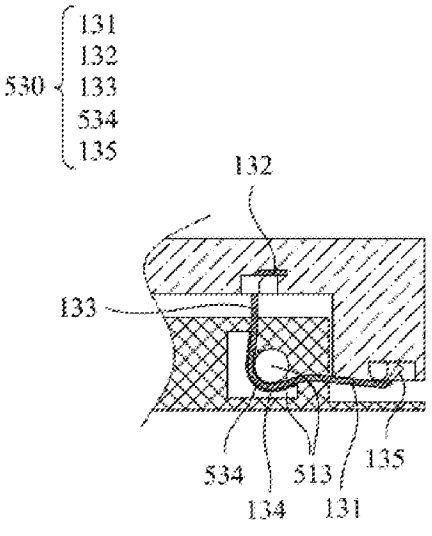
FIG. 6A is a side view of a reset mechanism when a fan housing is in an extended state according to an implementation of this disclosure.

FIG. 6A is a side view of a reset mechanism 530 when a housing of a fan 100 is in an extended state according to an implementation of this disclosure; and FIG. 6B is a side view of the reset mechanism 530 when the housing of the fan 100 in FIG. 6A is in a folded state. A difference between this implementation and the implementation in FIG. 2A and FIG. 2B is that: in this implementation, the reset mechanism 530 is an elastomer, and a connecting portion 534 of the reset mechanism 530 is embedded in a third projection 513. In this implementation, the elastomer is made of plastic, metal, or another elastic material.

Figure 7B:
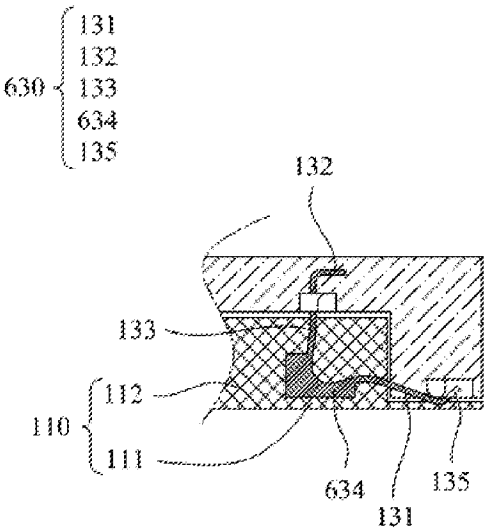
FIG. 7B is a side view of the reset mechanism when the fan housing in FIG. 7A is in a folded state.
Figure 7A:
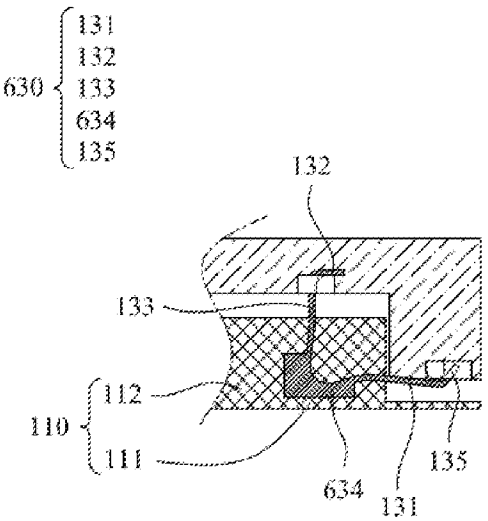
FIG. 7A is a side view of a reset mechanism when a fan housing is in an extended state according to an implementation of this disclosure.

Next, refer to FIG. 7A and FIG. 7B. FIG. 7A is a side view of a reset mechanism 630 when a housing of a fan 100 is in an extended state according to an implementation of this disclosure; and FIG. 7B is a side view of the reset mechanism 630 when the housing of the fan 100 in FIG. 7A is in a folded state. A difference between this implementation and the implementation in FIG. 6A and FIG. 6B is that: in this implementation, a connecting portion 634 of the reset mechanism 630 is directly disposed on a first side wall 112 of a first case 110. In this implementation, the reset mechanism 630 is integrated by using plastic, metal, or another elastic material.

The present disclosure is disclosed through the foregoing embodiments; however, these embodiments are not intended to limit the present disclosure. A person of ordinary skill in the art can make some changes and modifications without departing from the spirit and scope of the present disclosure. The protection scope of the present disclosure is subject to the appended claims.

What is claimed is:

1. A fan, comprising:

a first case, comprising a first side wall, wherein the first side wall has a first guide portion;

a second case, comprising a second side wall, a first projection, and a second projection, wherein the second side wall has a second guide portion, the first guide portion and the second guide portion are slidably joined, and are configured to enable the first case and the second case to move toward or away from each other, and the first projection and the second projection are disposed on the second side wall; and a reset mechanism, connected to the first case, and configured to push the second case to move away from the first case, wherein the reset mechanism comprises a pushing portion and a stopping portion, the pushing portion is configured to push the first projection, the stopping portion is connected to the pushing portion, and the stopping portion is located on a side of the second projection distant from the first case and is configured to be abutted by the second projection.

2. The fan according to claim 1, wherein the first projection is of an L shape, and the pushing portion extends to be between the first projection and the second side wall.

3. The fan according to claim 1, wherein the reset mechanism further comprises an abutting portion, the abutting portion is connected between the pushing portion and the stopping portion and is configured to abut the second projection.

4. The fan according to claim 3, wherein the second case is configured to move relative to the first case in a first direction, the abutting portion is configured to abut the second projection in a second direction perpendicular to the first direction, the abutting portion has a first engaging structure, and the first engaging structure is configured to engage with the second projection.

5. The fan according to claim 4, wherein the reset mechanism further comprises an extended portion, the stopping portion is connected between the abutting portion and the extended portion, and the extended portion is bent relative to the stopping portion, and has a second engaging structure.

6. The fan according to claim 3, wherein the reset mechanism further comprises a connecting portion, the connecting portion is connected between the pushing portion and the abutting portion, and the connecting portion is connected to the first case.

7. The fan according to claim 6, wherein the first case comprises a third projection, the third projection is disposed on the first side wall, and the connecting portion is of a ring shape and is sleeved over the third projection.

8. The fan according to claim 6, wherein the first case comprises a third projection, the third projection is disposed on the first side wall, and the connecting portion is embedded in the third projection.

* * * * *